US008123874B2

(12) United States Patent
Ishimine et al.

(10) Patent No.: US 8,123,874 B2
(45) Date of Patent: Feb. 28, 2012

(54) SOFT MAGNETIC MATERIAL, DUST CORE, METHOD FOR MANUFACTURING SOFT MAGNETIC MATERIAL, AND METHOD FOR MANUFACTURING DUST CORE

(75) Inventors: Tomoyuki Ishimine, Itami (JP); Toshihiro Sakamoto, Itami (JP); Toru Maeda, Itami (JP); Naoto Igarashi, Itami (JP)

(73) Assignee: Sumitomo Electric Industries, Ltd., Osaka-Shi (JP)

( * ) Notice: Subject to any disclaimer, the term of this patent is extended or adjusted under 35 U.S.C. 154(b) by 311 days.

(21) Appl. No.: 12/518,498

(22) PCT Filed: Sep. 3, 2008

(86) PCT No.: PCT/JP2008/065876

§ 371 (c)(1),
(2), (4) Date: Jun. 10, 2009

(87) PCT Pub. No.: WO2009/034894

PCT Pub. Date: Mar. 19, 2009

(65) Prior Publication Data

US 2010/0044618 A1 Feb. 25, 2010

(30) Foreign Application Priority Data

Sep. 11, 2007 (JP) ..... 2007-235637

(51) Int. Cl.
*H01F 1/20* (2006.01)

(52) U.S. Cl. ..... 148/306; 75/255

(58) Field of Classification Search ..... None
See application file for complete search history.

(56) References Cited

U.S. PATENT DOCUMENTS

| | | | | |
|---|---|---|---|---|
| 2001/0016977 | A1 | 8/2001 | Moro et al. | |
| 2007/0154833 | A1* | 7/2007 | Kayamoto et al. | 430/111.31 |
| 2008/0061264 | A1 | 3/2008 | Maeda et al. | |
| 2010/0194516 | A1* | 8/2010 | Sato et al. | 336/221 |

FOREIGN PATENT DOCUMENTS

| | | |
|---|---|---|
| JP | 63-19448 | 4/1988 |
| JP | 2001-102207 A | 4/2001 |
| JP | 2004-319652 | 11/2004 |
| JP | 2006-283166 | 10/2006 |
| JP | 2006-302958 | 11/2006 |
| WO | WO 2007/052411 | 5/2007 |

OTHER PUBLICATIONS

German, Randall M., "Powder metallurgy of iron and steel," New York, John Wiley and Sons, 1998, pp. 72-81.

* cited by examiner

*Primary Examiner* — John Sheehan
(74) *Attorney, Agent, or Firm* — Venable LLP; Michael A. Sartori; Michael E. Nelson

(57) ABSTRACT

A soft magnetic material, a dust core, a method for manufacturing the soft magnetic material, and a method for manufacturing the dust core that can improve DC bias characteristics are provided.

A soft magnetic material includes a plurality of metal magnetic particles 10 whose coefficient of variation Cv ($\sigma/\mu$), which is a ratio of a standard deviation ($\sigma$) of a particle size of the metal magnetic particles 10 to an average particle size ($\mu$) thereof, is 0.40 or less and whose circularity Sf is 0.80 or more and 1 or less. The metal magnetic particles 10 preferably have an average particle size of 1 μm or more and 70 μm or less. The soft magnetic material preferably further includes an insulating coated film that surrounds a surface of each of the metal magnetic particles 10.

11 Claims, 7 Drawing Sheets

SOFT MAGNETIC MATERIAL, DUST CORE, METHOD FOR MANUFACTURING SOFT MAGNETIC MATERIAL, AND METHOD FOR MANUFACTURING DUST CORE

TECHNICAL FIELD

The present invention relates to a soft magnetic material, a dust core, a method for manufacturing the soft magnetic material, and a method for manufacturing the dust core. For example, the present invention relates to a soft magnetic material that does not easily cause magnetic saturation and provides excellent direct current (DC) bias characteristics when used for a magnetic core of an inverter or the like, a dust core, a method for manufacturing the soft magnetic material, and a method for manufacturing the dust core.

BACKGROUND ART

A magnetic steel sheet has been used as a soft magnetic material utilized for an iron core of a static apparatus such as a transformer, a choke coil, and an inverter. However, a dust core is investigated as an alternative material of the magnetic steel sheet.

In general, the waveform of a current applied to a coil of a static apparatus includes a direct-current component together with an alternating-current component. When a DC current increases, the inductance of the coil decreases. As a result, the impedance decreases, thereby causing a problem in that, for example, an output decreases or a power conversion efficiency drops. Therefore, a soft magnetic material used for a static apparatus is required to have characteristics such as a low inductance drop with an increase in a DC current, that is, excellent DC bias characteristics and a low loss (low iron loss).

However, dust cores are inferior to magnetic steel sheets in terms of DC bias characteristics. This is because an inductance drop with an increase in a DC current is caused by magnetic saturation of soft magnetic materials. Specifically, the magnetic field applied to soft magnetic materials becomes large with increasing DC current. Consequently, magnetic saturation decreases magnet permeability. Since inductance is proportional to magnetic permeability, inductance drops.

To improve the DC bias characteristics of dust cores, a method for manufacturing a core and the core are disclosed in Japanese Unexamined Patent Application Publication No. 2004-319652 (Patent Document 1). Patent Document 1 discloses that an irregular soft magnetic powder having a particle size of 5 to 70 μm is used.

[Patent Document 1] Japanese Unexamined Patent Application Publication No. 2004-319652

DISCLOSURE OF INVENTION

Problems to be Solved by the Invention

However, in the core disclosed in Patent Document 1, only a range of a particle size is specified, and therefore there exists the variation in the particle size of the powder within the range described above. Accordingly, when the powder is molded, the uniformity of the inside of the core is decreased and there is still room for improvement in terms of DC bias characteristics.

To solve the problem described above, it is an object of the present invention to provide a soft magnetic material, a dust core, a method for manufacturing the soft magnetic material, and a method for manufacturing the dust core that can improve DC bias characteristics.

Means for Solving the Problems

A soft magnetic material of the present invention includes a plurality of metal magnetic particles. In the soft magnetic material, a coefficient of variation Cv ($\sigma/\mu$), which is a ratio of a standard deviation ($\sigma$) of a particle size of the metal magnetic particles to an average particle size ($\mu$) thereof, is 0.40 or less and a circularity Sf of the metal magnetic particles is 0.80 or more and 1 or less.

A method for manufacturing a soft magnetic material of the present invention includes a preparation step of preparing a plurality of metal magnetic particles. In the preparation step, the metal magnetic particles whose coefficient of variation Cv ($\sigma/\mu$), which is a ratio of a standard deviation ($\sigma$) of a particle size to an average particle size ($\mu$), is 0.40 or less and whose circularity Sf is 0.80 or more and 1 or less are prepared.

In the soft magnetic material and the method for manufacturing the soft magnetic material of the present invention, the particle size distribution of the Metal magnetic particles can be uniformized by controlling the coefficient of variation Cv of the metal magnetic particles to 0.40 or less. Thus, the uniformity of the inside of a compact made of the soft magnetic material by compacting can be improved. This can facilitate the domain wall motion in a magnetization process and improve DC bias characteristics. Furthermore, because a distortion arising on a surface of each of the metal magnetic particles when the soft magnetic material is pressure-molded can be reduced by controlling the circularity Sf of the metal magnetic particles to 0.80 or more, the DC bias characteristics can be improved. In a case where the external shape of the metal magnetic particles is completely spherical, the circularity Sf of the metal magnetic particles is 1.

"The standard deviation ($\sigma$) of a particle size" mentioned herein means a value calculated from the particle size of the metal magnetic particles measured by a laser diffraction/scattering particle size distribution analysis method. "The average particle size ($\mu$) of the metal magnetic particles" mentioned herein means a particle size of a particle at which the cumulative sum of the masses of particles starting from the smallest particle size reaches 50% in a histogram of particle sizes of the metal magnetic particles measured by a laser diffraction/scattering particle size distribution analysis method, that is, a 50% particle size. "The circularity of the metal magnetic particles" is specified by the following Eq. 1. In Eq. 1, the area and circumference of the metal magnetic particles can be determined by an optical method. For example, in the optical method, the area and circumference are statistically calculated from a projection image of each of the metal magnetic particles obtained by projecting the metal magnetic particles to be measured, using a commercially available image-processing device.

$$\text{Circularity} = 4\pi \times (\text{Area of Metal Magnetic Particle}) / (\text{Square of Circumference of Metal Magnetic Particle}) \quad \text{(Eq. 1)}$$

In the soft magnetic material described above, the metal magnetic particles preferably have an average particle size of 1 μm or more and 70 μm or less.

In the method for manufacturing the soft magnetic material described above, in the preparation step, the metal magnetic particles having an average particle size of 1 μm or more and 70 μm or less are preferably prepared.

By controlling the average particle size of the metal magnetic particles to 1 μm or more, an increase in a coercive force and a hysteresis loss of a dust core made of the soft magnetic material can be suppressed without decreasing the flowability of the soft magnetic material. By controlling the average particle size of the metal magnetic particles to 70 μm or less, an eddy current loss arising in a high-frequency range of 1 kHz or more can be effectively reduced.

The soft magnetic material described above preferably further includes an additive composed of at least one of a metallic soap and an inorganic lubricant with a hexagonal crystal structure. In the soft magnetic material, a ratio of the additive to the plurality of metal magnetic particles is preferably 0.001% by mass or more and 0.2% by mass or less.

The method for manufacturing the soft magnetic material described above preferably further includes an addition step of adding an additive composed of at least one of a metallic soap and an inorganic lubricant with a hexagonal crystal structure, a ratio of the additive to the plurality of metal magnetic particles being 0.001% by mass or more and 0.2% by mass or less.

By controlling the ratio of the additive to 0.001% by mass or more, the flowability of the metal magnetic particles can be improved due to high lubricity of the metallic soap and the inorganic lubricant with a hexagonal crystal structure. This can improve the filling properties of the soft magnetic material when the soft magnetic material is filled in a die. As a result, since the density of a compact into which the soft magnetic material is molded can be increased, the DC bias characteristics can be improved. By controlling the ratio of the additive to 0.2% by mass or less, a decrease in the density of a compact into which the soft magnetic material is molded can be suppressed. This can prevent the degradation of the DC bias characteristics.

The soft magnetic material described above preferably further includes an insulating coated film that surrounds a surface of each of the metal magnetic particles.

The method for manufacturing the soft magnetic material described above preferably further includes an insulating coated film formation step of forming an insulating coated film on a surface of each of the metal magnetic particles.

Since the insulating coated film surrounds a surface of each of the metal magnetic particles having a circularity Sf of 0.80 or more, the insulating coated film is formed between the metal magnetic particles in a compact. As a result, the metal magnetic particles can be effectively insulated, thereby decreasing an eddy current loss. Thus, an iron loss can be effectively reduced in a high-frequency range.

Particularly in a case where the soft magnetic material further includes at least one of a metallic soap and an inorganic lubricant with a hexagonal crystal structure, the damage to the insulating coated film can be further reduced when the soft magnetic material is molded. Consequently, the insulation properties between the metal magnetic particles can be further improved even in a high temperature atmosphere, thereby further decreasing an eddy current loss. Thus, an iron loss can be more effectively reduced in a high-frequency range.

In the soft magnetic material described above, the insulating coated film is preferably composed of at least one material selected from the group consisting of a phosphoric acid compound, a silicon compound, a zirconium compound, and a boron compound.

In the method for manufacturing the soft magnetic material described above, in the insulating coated film formation step, the insulating coated film composed of at least one material selected from the group consisting of a phosphoric acid compound, a silicon compound, a zirconium compound, and a boron compound is preferably formed.

Because these materials have excellent insulation properties, an eddy current flowing between the metal magnetic particles can be more effectively suppressed.

In the soft magnetic material described above, the insulating coated film is preferably one insulating coated film; the metal magnetic particles each preferably includes another insulating coated film that surrounds a surface of the one insulating coated film; and the other insulating coated film preferably contains a thermosetting silicone resin.

In the method for manufacturing the soft magnetic material described above, a insulating coated film formation step preferably includes one insulating coated film formation step of forming the insulating coated film as one insulating coated film; and another insulating coated film formation step of forming another insulating coated film that surrounds a surface of the one insulating coated film. In the other insulating coated film formation step, the other insulating coated film containing a thermosetting silicone resin is preferably formed.

The one insulating coated film is protected by the other insulating coated film, whereby the temperature increase of the insulating coated film can be suppressed by the other insulating coated film during the heat-treatment of the soft magnetic material. Thus, the soft magnetic material in which the heat-resistance of the insulating coated film is improved is achieved. The material described above has high heat-resistance while increasing the bonding strength between composite magnetic particles each including each of the metal magnetic particles and the insulating coated film.

A dust core of the present invention is manufactured using the soft magnetic material. A method for manufacturing a dust core of the present invention includes the steps of manufacturing a soft magnetic material using the method for manufacturing the soft magnetic material; and manufacturing the dust core by compacting the soft magnetic material.

Advantages

As is seen, in the soft magnetic material and the method for manufacturing the soft magnetic material of the present invention, the plurality of metal magnetic particles whose coefficient of variation Cv is 0.40 or less and circularity Sf is 0.80 or more and 1 or less are included, which can improve DC bias characteristics.

REFERENCE NUMERALS

Figure 1:
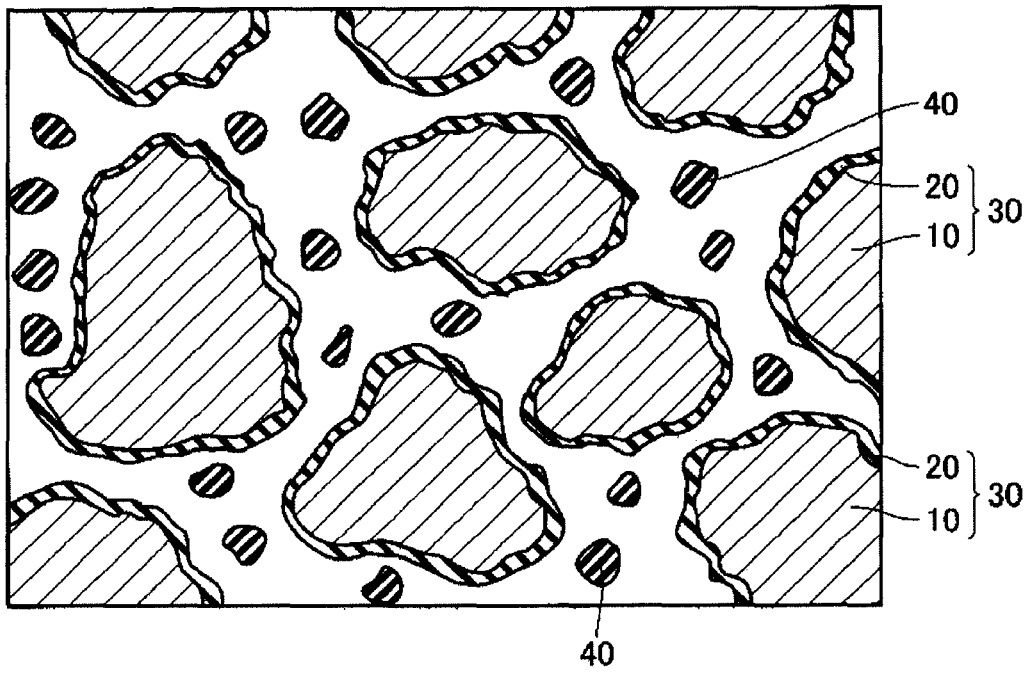
FIG. 1 is a schematic view showing a soft magnetic material according to an embodiment of the present invention.

10 metal magnetic particle
20 insulating coated film
20*a* one insulating coated film
20*b* another insulating coated film
30 composite magnetic particle
40 additive
50 insulation

BEST MODE FOR CARRYING OUT THE INVENTION

An embodiment of the present invention will now be described with reference to drawings. The same or corresponding parts in the drawings are designated by the same reference numerals, and the descriptions are not repeated.

FIG. 1 is a schematic view showing a soft magnetic material according to an embodiment of the present invention. As shown in FIG. 1, the soft magnetic material according to this embodiment includes a plurality of composite magnetic particles 30 each having a metal magnetic particle 10 and an insulating coated film 20 that surrounds a surface of the metal magnetic particle 10; and an additive 40 composed of at least one of a metallic soap and an inorganic lubricant with a hexagonal crystal structure.

Figure 2:
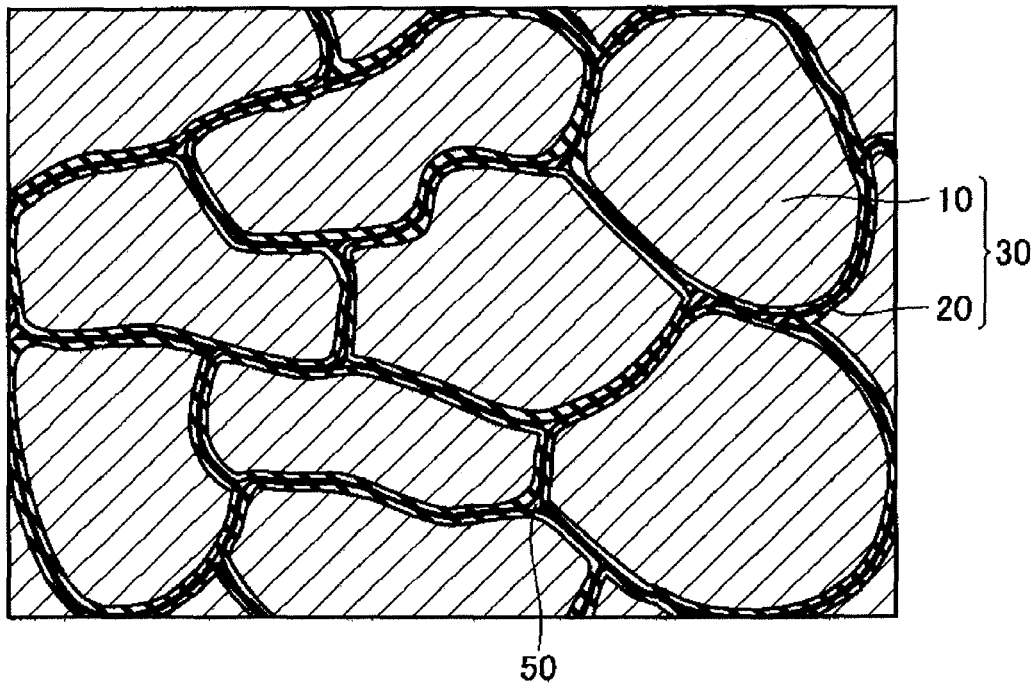
FIG. 2 is an enlarged sectional view of a dust core according to the embodiment of the present invention.

FIG. 2 is an enlarged sectional view of a dust core according to the embodiment of the present invention. The dust core of FIG. 2 is manufactured by compacting and heat-treating the soft magnetic material of FIG. 1. In the dust core of this embodiment, as shown in FIGS. 1 and 2, the plurality of composite magnetic particles 30 are bonded to each other by an insulation 50 or by the engagement of the projections and indentations of the composite magnetic particles 30. The insulation 50 is the one into which the additive 40, resins (not shown), and the like included in the soft magnetic material are changed during the heat treatment.

In the soft magnetic material and the dust core of the present invention, a coefficient of variation Cv ($\sigma/\mu$), which is a ratio of the standard deviation ($\sigma$) of the particle size of the metal magnetic particle 10 to its average particle size ($\mu$), is 0.40 or less and the circularity Sf of the metal magnetic particle 10 is 0.80 or more and 1 or less.

The coefficient of variation Cv of the metal magnetic particle 10 is 0.40 or less, preferably 0.38 or less, more preferably 0.36 or less. Because the particle size distribution can be uniformized by controlling the coefficient of variation Cv to 0.40 or less, the uniformity of the inside of a compact made of the soft magnetic material can be improved. This can facilitate the domain wall motion in a magnetization process and improve DC bias characteristics. The DC bias characteristics can be further improved by controlling the coefficient of variation Cv to 0.38 or less. The DC bias characteristics can be more effectively improved by controlling the coefficient of variation Cv to 0.36 or less. Although the coefficient of variation Cv preferably has a smaller value, it is 0.001 or more in terms of, for example, ease of manufacturing.

Figure 3:
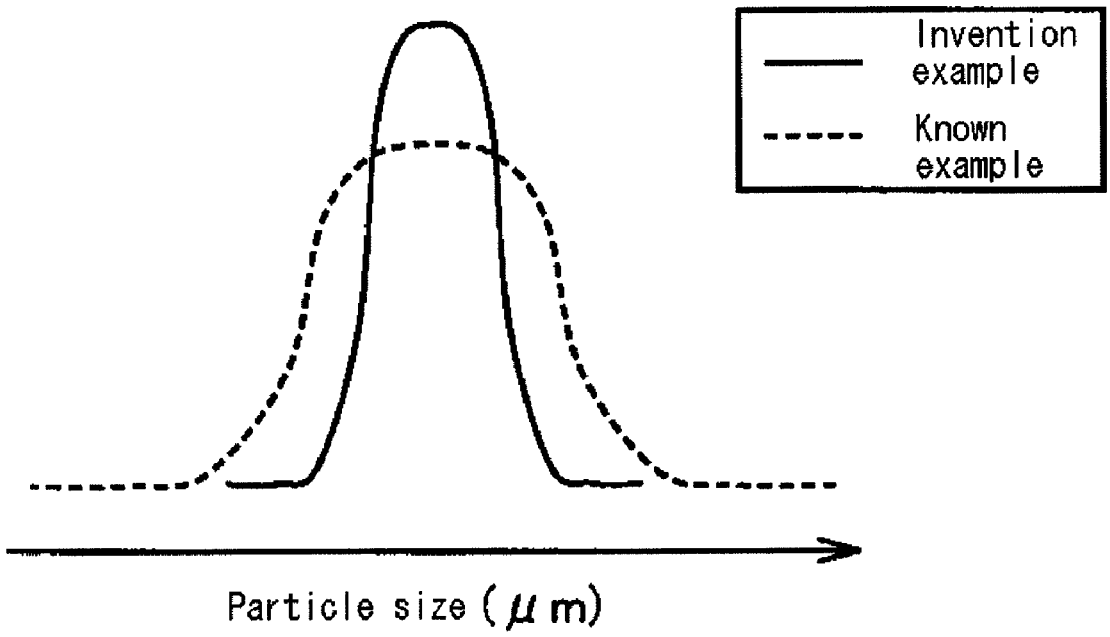
FIG. 3 is a schematic view showing the particle size distribution of a metal magnetic particle according to the embodiment of the present invention and the particle size distribution of a metal magnetic particle of a known example.

FIG. 3 is a schematic view showing the particle size distribution of the metal magnetic particle 10 according to the embodiment of the present invention and the particle size distribution of a metal magnetic particle of a known example. As shown in FIG. 3, since the coefficient of variation of the metal magnetic particle 10 according to this embodiment (invention example in FIG. 3) is 0.40 or less, the standard deviation ($\sigma$) of its particle size, that is, the variation of its particle size is smaller than that in the known example.

The circularity Sf of the metal magnetic particle 10 is 0.80 or more and 1 or less, preferably 0.91 or more and 1 or less, more preferably 0.92 or more and 1 or less. Because a distortion arising on a surface of the metal magnetic particle when the soft magnetic material is molded can be reduced by controlling the circularity Sf to 0.80 or more, the DC bias characteristics can be improved. The DC bias characteristics can be further improved by controlling the circularity Sf to 0.91 or more. The DC bias characteristics can be more effectively improved by controlling the circularity Sf to 0.92 or more. In a case where the external shape of the metal magnetic particle is completely spherical, the circularity Sf of the metal magnetic particle is 1.

Figure 4A:
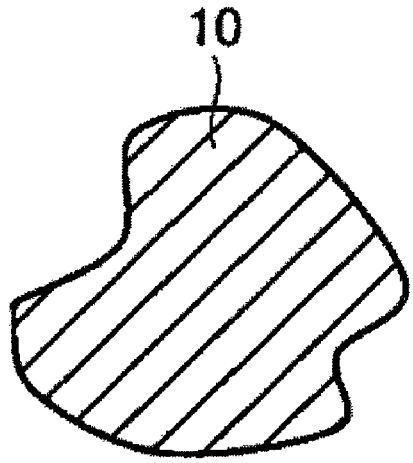
FIG. 4A is a schematic view showing a shape of the metal magnetic particle according to the embodiment of the present invention.
Figure 4B:
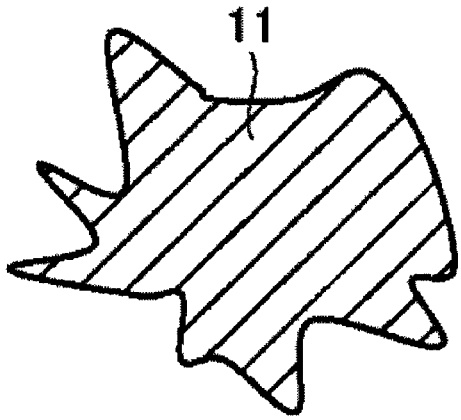
FIG. 4B is a schematic view showing a shape of a metal magnetic particle of the known example.

FIG. 4A is a schematic view showing a shape of the metal magnetic particle 10 according to the embodiment of the present invention. FIG. 4B is a schematic view showing a shape of a metal magnetic particle 11 of the known example. As shown in FIGS. 4A and 4B, since the circularity Sf of the metal magnetic particle 10 according to this embodiment is 0.80 or more and 1 or less, the metal magnetic particle 10 is more spherical than the metal magnetic particle 11 of the known example.

The average particle size (g) of the metal magnetic particle 10 is preferably 1 μm or more and 70 μm or less, more preferably 1 μm or more and 65 μm or less, more preferably 20 μm or more and 60 μm or less. By controlling the average particle size of the metal magnetic particle 10 to 1 μm or more, an increase in a coercive force and a hysteresis loss of the dust core made of the soft magnetic material can be suppressed without decreasing the flowability of the soft magnetic material. By controlling the average particle size to 20 μm or more, an increase in a coercive force and a hysteresis loss of the dust core made of the soft magnetic material can be further suppressed. By controlling the average particle size of the metal magnetic particle 10 to 70 μm or less, an eddy current loss arising in a high-frequency range of 1 kHz or more can be effectively reduced. By controlling the average particle size to 65 μm or less, an eddy current loss can be more effectively reduced. By controlling the average particle size to 60 μm or less, an eddy current loss can be far more effectively reduced.

Examples of the material forming the metal magnetic particle 10 include iron (Fe), iron (Fe)-aluminum (Al) alloys, iron (Fe)-silicon (Si) alloys, iron (Fe)-nitrogen (N) alloys, iron (Fe)-nickel (Ni) alloys, iron (Fe)-carbon (C) alloys, iron (Fe)-boron (B) alloys, iron (Fe)-cobalt (Co) alloys, iron (Fe)-phosphorus (P) alloys, iron (Fe)-nickel (Ni)-cobalt (Co) alloys, iron (Fe)-aluminum (Si) alloys, iron (Fe)-aluminum (Al)-chromium(Cr) alloys, iron (Fe)-aluminum (Al)-manganese (Mn) alloys, iron (Fe)-aluminum (Al)-nickel (Ni) alloys, iron (Fe)-silicon (Si)-chromium(Cr) alloys, iron (Fe)-silicon (Si)-manganese (Mn) alloys, and iron (Fe)-silicon (Si)-nickel (Ni) alloys. The metal magnetic particle 10 may be made of a single metal or an alloy.

The soft magnetic material shown in FIG. 1 and the dust core shown in FIG. 2 preferably further include the insulating coated film 20 that surrounds a surface of the metal magnetic particle 10. The insulating coated film 20 functions as an insulating layer between the metal magnetic particles 10. The electric resistivity ρ of the dust core obtained after compacting the soft magnetic material can be increased by coating the metal magnetic particle 10 with the insulating coated film 20. This can suppress an eddy current flowing between the metal magnetic particles 10 and reduce an eddy current loss of the dust core.

The average film thickness of the insulating coated film 20 is preferably 10 nm or more and 1 μm or less. An eddy current loss can be effectively suppressed by controlling the average film thickness of the insulating coated film 20 to 10 nm or more. Share fracture of the insulating coated film 20 during compacting can be prevented by controlling the average film thickness of the insulating coated film 20 to 1 μm or less. Furthermore, since the ratio of the insulating coated film 20 to the soft magnetic material does not become too high, the flux density of the dust core obtained after compacting the soft magnetic material can be prevented from significantly decreasing.

The "average thickness" mentioned herein is determined by deriving an equivalent thickness, taking into account the film composition measured by composition analysis (transmission electron microscope energy dispersive X-ray spectroscopy (TEM-EDX)) and the element contents measured by inductively coupled plasma-mass spectroscopy (ICP-MS), and then by directly observing the film using a TEM image and confirming that the order of magnitude of the equivalent thickness derived above is a proper value.

The insulating coated film 20 is preferably composed of at least one material selected from the group consisting of a phosphoric acid compound, a silicon compound, a zirconium compound, and a boron compound. Because these materials have excellent insulation properties, an eddy current flowing between the metal magnetic particles 10 can be effectively suppressed. Specifically, the insulating coated film 20 is preferably composed of silicon oxide, zirconium oxide, or the like. In particular, a coating layer that coats a surface of the metal magnetic particle can be further thinned by using a phosphate-containing metal oxide for the insulating coated film 20. This is because the flux density of the composite magnetic particles 30 can be increased by using such a metal oxide and the magnetic characteristics thereof are improved.

The insulating coated film 20 may be composed of a metal such as Fe (iron), Al (aluminum), Ca (calcium), Mn (manganese), Zn (zinc), Mg (magnesium), V (vanadium), Cr (chromium), Y (yttrium), Ba (barium), or Sr (strontium). It may be composed of a metal oxide of a rare-earth element, a metal nitride, a metal oxide, a metal phosphate compound, a metal borate compound, a metal silicate compound, or the like.

The insulating coated film 20 may also be composed of an amorphous phosphate compound of at least one material selected from the group consisting of Al (aluminum), Si (silicon), Mg (magnesium), Y (yttrium), Ca (calcium), Zr (zirconium), and Fe (iron), and an amorphous borate compound of the at least one material.

The insulating coated film 20 may also be composed of an amorphous oxide compound of at least one material selected from the group consisting of Si, Mg, Y, Ca, and Zr.

Although a case where a composite magnetic particle constituting a soft magnetic material has an insulating coated film with one layer is shown above, the composite magnetic particle constituting the soft magnetic material may have an insulating coated film with a plurality of layers as described below.

Figure 5:
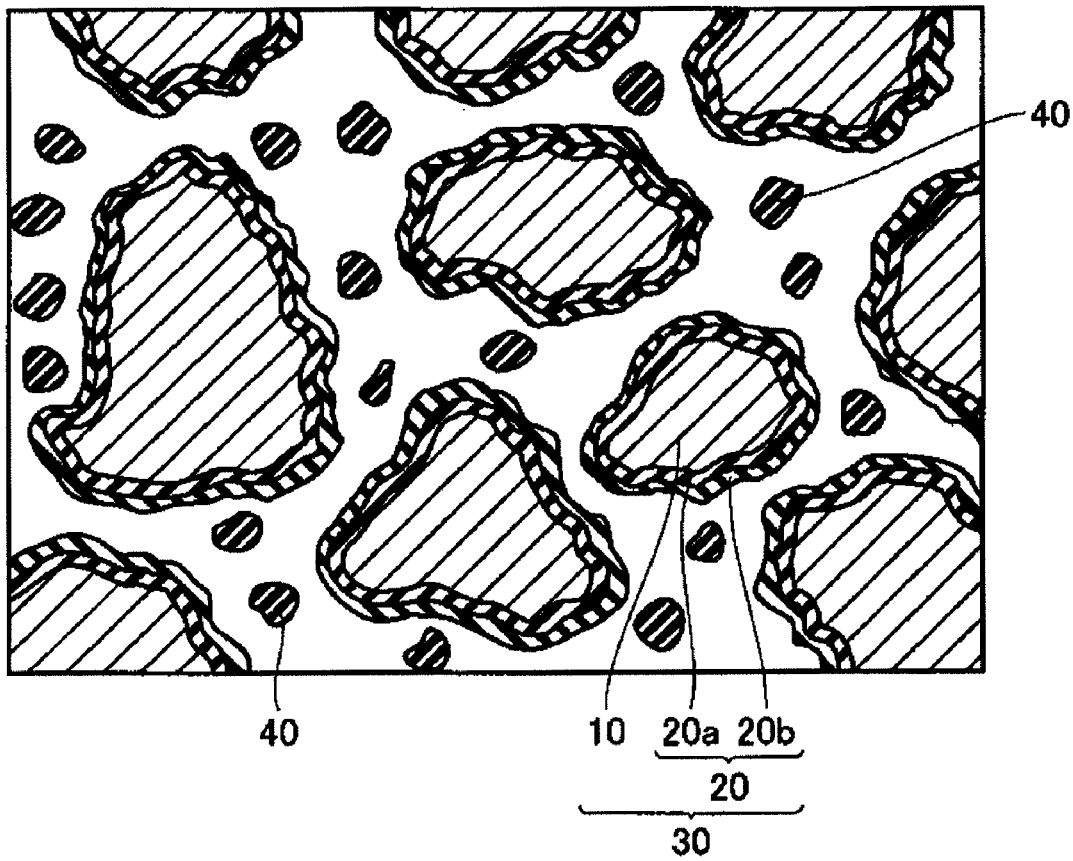
FIG. 5 is a schematic view showing another soft magnetic material according to the embodiment of the present invention.

FIG. 5 is a schematic view showing another soft magnetic material according to the embodiment of the present invention. In the other soft magnetic material according to this embodiment, as shown in FIG. 5, the insulating coated film 20 includes one insulating coated film 20*a* and another insulating coated film 20*b*. The one insulating coated film 20*a* surrounds a surface of the metal magnetic particle 10 and the other insulating coated film 20*b* surrounds a surface of the one insulating coated film 20*a*.

The one insulating coated film 20*a* has substantially the same structure as the insulating coated film 20 shown in FIGS. 1 and 2.

A silicone resin, a thermoplastic resin, a non-thermoplastic resin, or a metal salt of higher fatty acid is preferably used as the other insulating coated film 20*b*. Specifically, a thermoplastic resin such as thermoplastic polyimide, thermoplastic polyamide, thermoplastic polyamide-imide, polyphenylene sulfide, polyethersulfone, polyetherimide or polyether ether ketone, high-molecular-weight polyethylene, or wholly aromatic polyester; a non-thermoplastic resin such as wholly aromatic polyimide or non-thermoplastic polyamide-imide; or a metal salt of higher fatty acid such as zinc stearate, lithium stearate, calcium stearate, lithium palmitate, calcium palmitate, lithium oleate, or calcium oleate is preferably used. In particular, the insulating coated film 20*b* is preferably composed of a thermosetting silicone resin. These organic materials can also be used as a mixture. The high-molecular-weight polyethylene is polyethylene with a molecular weight of 100 thousands or more.

Each of the one insulating coated film 20*a* and the other insulating coated film 20*b* is not necessarily constituted by a single layer. Each of the one insulating coated film 20*a* and the other insulating coated film 20*b* may be constituted by a plurality of layers.

The soft magnetic material shown in FIG. 1 and the dust core shown in FIG. 2 preferably further include the additive 40 composed of at least one of a metallic soap and an inorganic lubricant with a hexagonal crystal structure.

Examples of the metallic soap include zinc stearate, lithium stearate, calcium stearate, lithium palmitate, calcium palmitate, lithium oleate, and calcium oleate. Examples of the inorganic lubricant with a hexagonal crystal structure include boron nitride, molybdenum disulfide, tungsten disulfide, and graphite.

The additive 40 is preferably included such that the ratio of the additive 40 to the plurality of metal magnetic particles 10 is 0.001% by mass or more and 0.2% by mass or less, more preferably 0.001% by mass or more and 0.1% by mass or less. By controlling the ratio of the additive 40 to 0.001% by mass or more, the flowability of the metal magnetic particles 10 can be improved due to high lubricity of the metallic soap and the inorganic lubricant with a hexagonal crystal structure. This can improve the filling properties of the soft magnetic material when the soft magnetic material is filled in a die. As a result, since the density of a compact into which the soft magnetic material is molded can be increased, the DC bias characteristics can be improved. By controlling the ratio of the additive 40 to 0.2% by mass or less, a decrease in the density of a compact into which the soft magnetic material is molded can be suppressed. This can prevent the degradation of the DC bias characteristics.

In particular, because the metallic soap and the inorganic lubricant with a hexagonal crystal structure constituting the additive 40 can impart good lubricity that suppresses damage to the insulating coated film 20, the damage to the insulating coated film 20 can be further reduced when the soft magnetic material is molded. As a result, the bonding strength between the metal magnetic particles 10 adjoining each other is maintained even in a high-temperature environment, which can further reduce an eddy current loss. Thus, an iron loss can be more effectively reduced in a high-frequency range.

The average particle size of the additive 40 is preferably 2.0 μm or less. By controlling the average particle size to 2.0 μm or less, the damage to the insulating coated film 20 can be further reduced when the soft magnetic material is pressure-molded, which can further reduce an iron loss.

"The average particle size of the additive 40" mentioned herein means a particle size of a particle at which the cumulative sum of the masses of particles starting from the smallest particle size reaches 50% in a histogram of particle sizes measured by a laser scattering/diffraction method, that is, a 50% particle size D.

The soft magnetic material shown in FIG. 1 may further include a lubricant or the like other than the additive 40 described above and a resin (not shown).

Figure 6:
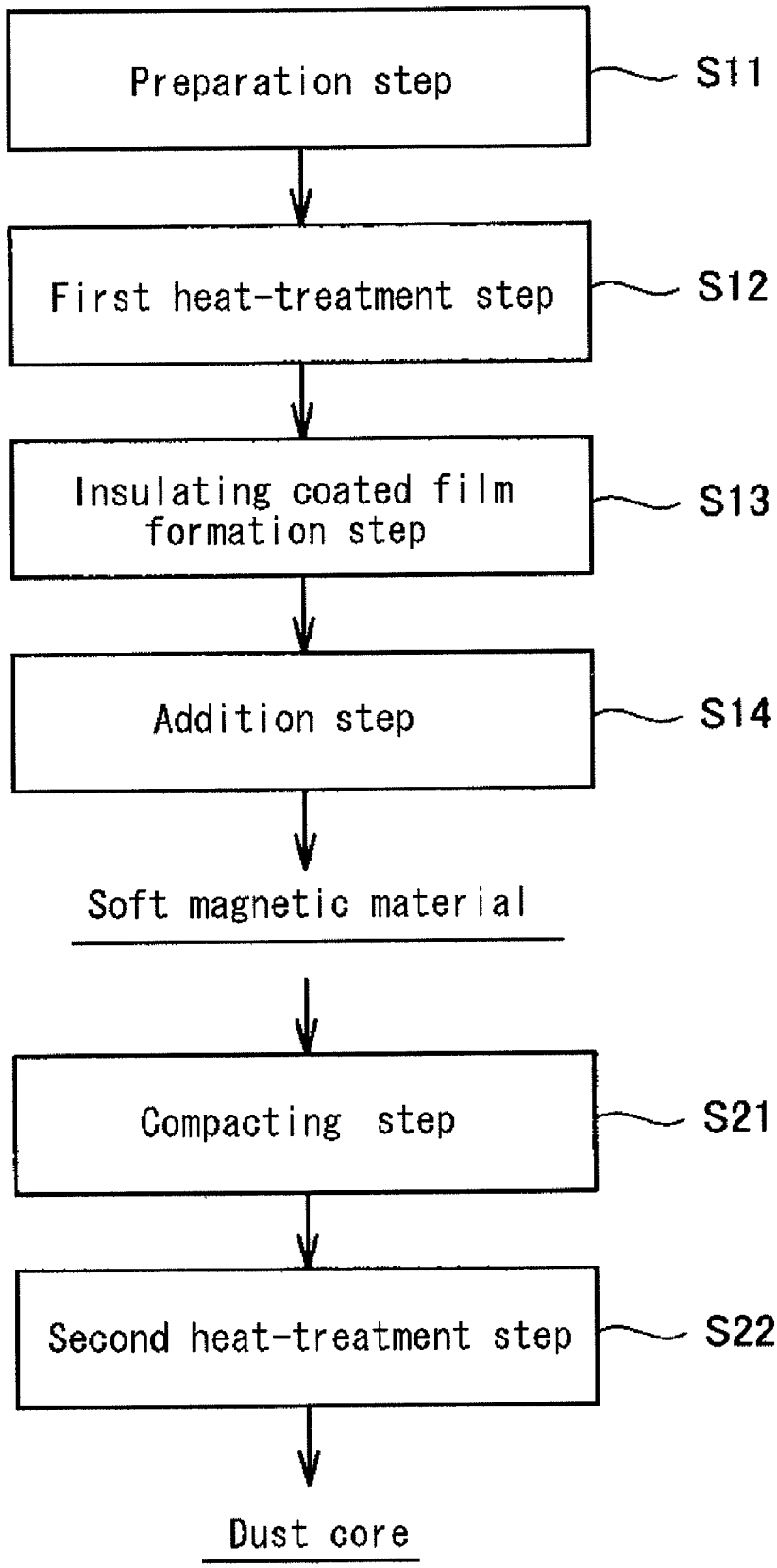
FIG. 6 is a flowchart showing a method for manufacturing the soft magnetic material according to the embodiment of the present invention.

A method for manufacturing the soft magnetic material of the present invention will now be described with reference to FIG. 6. FIG. 6 is a flowchart showing a method for manufacturing the soft magnetic material according to the embodiment of the present invention.

As shown in FIG. 6, a preparation step (S11) of preparing a plurality of metal magnetic particles 10 is conducted first. In the preparation step (S11), the metal magnetic particles 10 whose coefficient of variation Cv (σ/μ), which is the ratio of the standard deviation (σ) of the particle size of the metal magnetic particles 10 to the average particle size (μ) of the metal magnetic particles 10, is 0.4 or less and whose circularity Sf is 0.8 or more and 1 or less, are prepared.

In the preparation step (S11), the plurality of metal magnetic particles 10 described above are prepared. These metal magnetic particles 10 are prepared by, for example, atomizing iron having a certain composition by an atomizing method, a water-atomizing method, or the like. In particular, in the preparation step (S11), the metal magnetic particles 10 having an average particle size of 1 μm or more and 70 μm or less are preferably prepared.

As shown in FIG. 6, a first heat-treatment step (S12) of heat-treating the plurality of metal magnetic particles 10 is then conducted. In the first heat-treatment step (S12), the plurality of metal magnetic particles 10 are heat-treated at a temperature of, for example, 700° C. or more and less than 1400° C. Before the heat-treatment, there are many defects such as distortions and grain boundaries caused by thermal stress or the like in an atomizing process inside the metal magnetic particles 10. These defects can be reduced by conducting the heat-treatment on the metal magnetic particles 10 in the first heat-treatment step (S12). The first heat-treatment step (S12) may be omitted.

As shown in FIG. 6, an insulating coated film formation step (S13) of forming an insulating coated film 20 on a surface of each of the metal magnetic particles 10 is then conducted. In the insulating coated film formation step (S13), the insulating coated film 20 described above (or one insulating coated film 20*a* and another insulating coated film 20*b*) is formed on a surface of each of the metal magnetic particles 10. Thus, a plurality of composite magnetic particles 30 are produced.

In the insulating coated film formation step (S13), the insulating coated film 20 composed of a phosphate can be formed by, for example, subjecting the metal magnetic particles 10 to phosphating treatment. Solvent spraying or sol-gel treatment using a precursor can be used as the method for forming the insulating coated film 20 composed of a phosphate instead of the phosphating treatment. Alternatively, the insulating coated film 20 may instead be formed of a silicon organic compound. This insulating coated film can be formed by wet coating treatment using an organic solvent, direct coating treatment with a mixer, or the like.

In the insulating coated film formation step (S13), the insulating coated film 20 composed of at least one material selected from the group consisting of a phosphoric compound, a silicon compound, a zirconium compound, and a boron compound is preferably formed. Specifically, the insulating coated film 20 composed of iron phosphate, manganese phosphate, zinc phosphate, calcium phosphate, silicon phosphate, zirconium phosphate, or the like is preferably formed.

In a case where the soft magnetic material having the one insulating coated film 20 with a plurality of layers is manufactured, as shown in FIG. 5, the insulating coated film formation step (S13) includes an insulating coated film step of forming the insulating coated film 20 as one insulating coated film 20*a* and another insulating coated film formation step of forming another insulating coated film 20*b* that surrounds a surface of the one insulating coated film 20*a*. The other insulating coated film 20*b* is preferably contains a thermosetting silicone resin.

In a case where an insulating coated film with two layers shown in FIG. 5 is formed, each of the metal magnetic particles 10 having the one insulating coated film 20*a* is mixed with an additive 40 added in an addition step (S14) described below to form the other insulating coated film 20*b*.

Instead of the method described above, the other insulating coated film 20*b* may be formed by mixing or spraying a silicone resin dissolved in an organic solvent and then by drying the silicone resin to remove the organic solvent.

As shown in FIG. 6, the addition step (S14) of adding the additive 40 composed of at least one of a metallic soap and an inorganic lubricant with a hexagonal crystal structure, such that the ratio of the additive 40 to the plurality of metal magnetic particles 10 is 0.001% by mass or more and 0.2% by mass or less, is then conducted. In the addition step (S14), the metal magnetic particles 10 are mixed with the additive 40. The mixing method is not limited. Examples of the method include mechanical alloying, vibrating ball mill, planetary ball mill, mechanofusion, coprecipitation, chemical vapor deposition (CVD), physical vapor deposition (PVD), plating, sputtering, vapor deposition, and sol-gel methods. A resin or another additive may be optionally added.

Through the steps (S11 to 514) described above, the soft magnetic material of this embodiment is obtained. To manufacture the dust core of this embodiment, the following steps will be further conducted.

A compacting step (S21) of filling a die with the resultant soft magnetic material and compacting it is then conducted. In the compacting step (S21), the soft magnetic material is pressure-molded at a pressure of 390 MPa or more and 1500 MPa or less. As a result, a compact into which the soft magnetic material is pressure-molded is obtained. The compacting is preferably conducted in an inert gas atmosphere or a reduced-pressure atmosphere. In this case, a mixed powder can be prevented from being oxidized by oxygen in the air.

If the addition step (S14) is conducted, the additive 40 composed of at least one of a metallic soap and an inorganic lubricant with a hexagonal crystal structure is present between the composite magnetic particles 30 adjoining each other. This prevents the composite magnetic particles 30 from being rubbed hard each other in the compacting step (S21). Since the additive 40 exhibits good lubricity, the insulating coated film 20 formed on the outer surface of each of the composite magnetic particles 30 is not broken. This can maintain the form in which the insulating coated film 20 coats a surface of each of the metal magnetic particles 10. Consequently, the insulating coated film 20 can function as an insulating layer between the metal magnetic particles 10 with certainty.

In the addition step (S14), instead of or in addition to the additive 40, another lubricant or resin may be added.

A second heat-treatment step (S22) of heat-treating the compact obtained by compacting is then conducted. In the second heat-treatment step (S22), the compact is heat-treated, for example, at a temperature between 575° C. and the pyrolysis temperature of the insulating coated film 20. There are many defects inside the compact after compacting. These defects can be removed by conducting the second heat-treatment step (S22). Furthermore, since the second heat-treatment step (S22) is conducted at a temperature less than the pyrolysis temperature of the insulating coated film 20, the insulating coated film 20 does not deteriorate due to the second heat-treatment step (S22). The second heat-treatment step (S22) changes the additive 40 into an insulation 50.

After the second heat-treatment step (S22), appropriate processing such as extrusion or cutting processing is optionally conducted on the compact to complete the dust core shown in FIG. 2.

Figure 7:
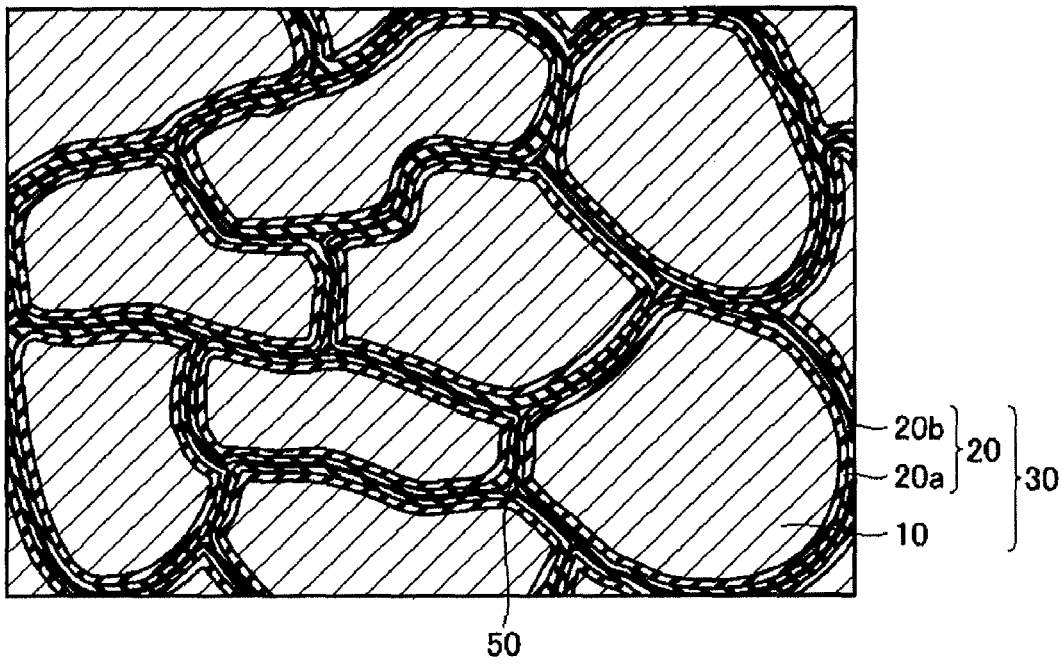
FIG. 7 is a schematic view showing another dust core according to the embodiment of the present invention.

Through the steps (S11 to S14 and S21 to S22) described above, the dust core of this embodiment shown in FIG. 2 can be manufactured. In a case where the soft magnetic material having the insulating coated film 20 with two layers is used, a dust core shown in FIG. 7 can be manufactured. FIG. 7 is a schematic view showing another dust core according to the embodiment of the present invention.

Figure 8:
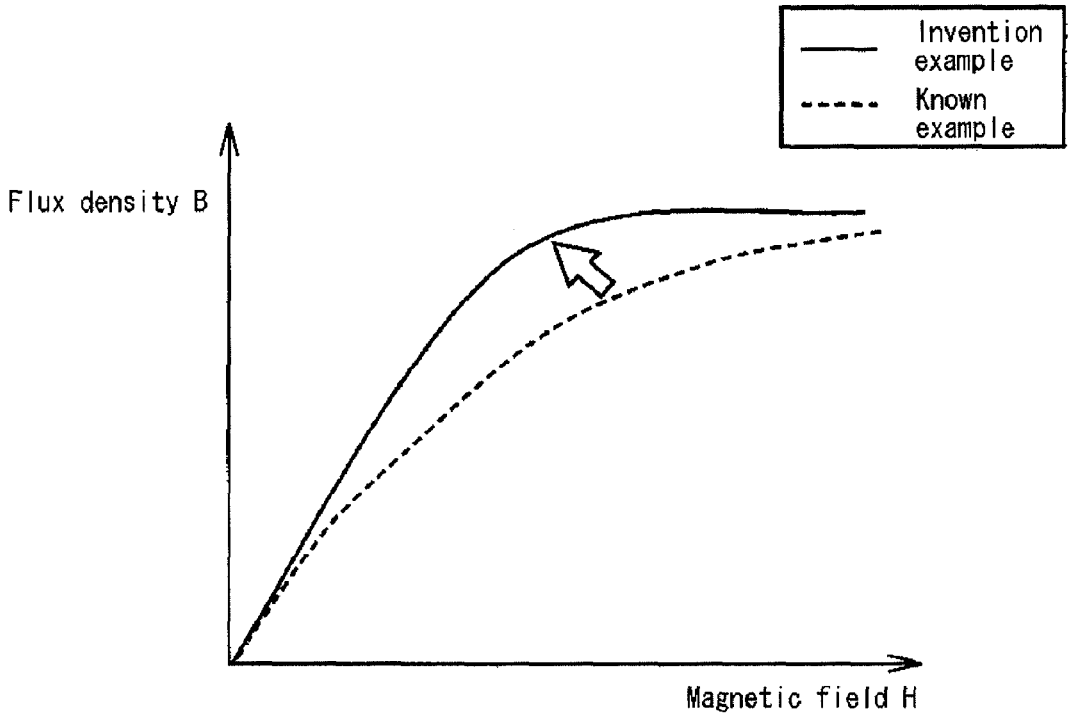
FIG. 8 is a graph showing a relationship between magnetic field and flux density according to the embodiment of the present invention.
Figure 9:
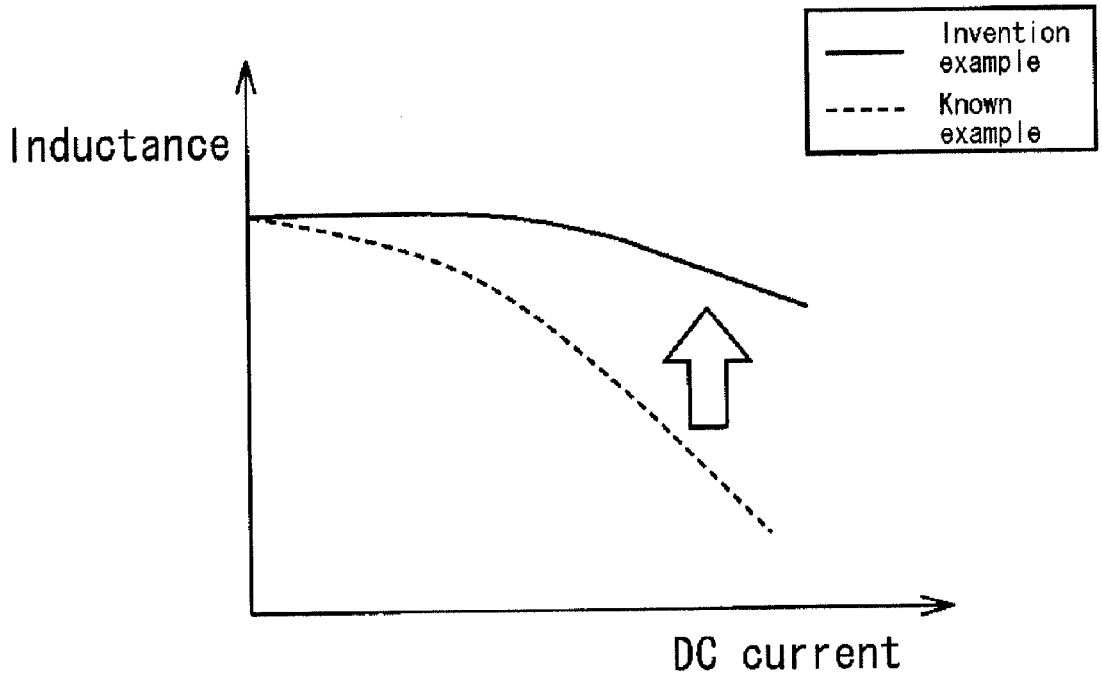
FIG. 9 is a graph showing a relationship between DC current and inductance according to the embodiment of the present invention.

As described above, the soft magnetic material according to the embodiment of the present invention includes the metal magnetic particles 10 whose coefficient of variation Cv ($\sigma/\mu$), which is the ratio of the standard deviation ($\sigma$) of the particle size to the average particle size ($\mu$), is 0.40 or less and whose circularity Sf is 0.80 or more and 1 or less. As shown in FIGS. 3, 4A, and 4B, since the coefficient of variation Cv ($\sigma/\mu$) is 0.40 or less, the variation in the particle size of the metal magnetic particles 10 can be reduced (uniform particle size distribution can be achieved). This can improve the uniformity of the inside of the dust core made of the soft magnetic material, thereby facilitating the domain wall motion in a magnetization process. Since the circularity Sf of the metal magnetic particles 10 is 0.8 or more, a distortion arising on a surface of each of the metal magnetic particles 10 when the soft magnetic material is pressure-molded can be reduced. As shown in FIG. 8, a combined effect of the coefficient of variation Cv and the circularity Sf of the metal magnetic particles 10 can improve flux density in a B-H curve. As a result, a reduction in inductance caused by an increase in a DC current can be suppressed as shown in FIG. 9. In other words, the DC bias characteristics can be improved. FIG. 8 is a graph showing a relationship between magnetic field and flux density according to the embodiment of the present invention. FIG. 9 is a graph showing a relationship between DC current and inductance according to the embodiment of the present invention. In FIGS. 8 and 9, the one described as an invention example shows the dust core made of the soft magnetic material including the metal magnetic particles 10 of this embodiment.

EXAMPLES

In these Examples, an effect provided by including metal magnetic particles whose coefficient of variation Cv ($\sigma/\mu$) is 0.40 or less and circularity Sf is 0.80 or more was examined.

Examples 1 to 4

In Example 1, the soft magnetic material manufactured by the method described in the embodiment above was used. Specifically, in the preparation step (S11), a metal magnetic particle containing 99.6% by weight or more of iron and the balance that is composed of incidental impurities such as 0.3% by weight or less of O and 0.1% by weight or less of C, N, P, Mn, or the like was prepared by water-atomizing an iron powder. The average particle sizes of the metal magnetic particles in Examples 1 to 4 were selected as described in Table. The coefficient of variation Cv and the circularity Sf of the metal magnetic particles in Examples 1 to 4 were as described in Table. The coefficient of variation Cv of the metal magnetic particles was calculated by measuring the particle size distribution of the targeted soft magnetic material (a plurality of metal magnetic particles) using a laser diffraction/scattering particle size distribution analysis method. The circularity Sf was statistically calculated from projection images of the metal magnetic particles whose area and circumference were measured, on the basis of Eq. (1) described above.

In the insulating coated film formation step (S13), the insulating coated film composed of iron phosphate was then formed by conducting phosphating treatment.

In the addition step (S14), 0.1% by mass of zinc stearate as a metallic soap was added in Examples 1 to 3. In Example 4, 0.1% by mass of ethylenebisstearamide that is a lubricant with a non-hexagonal crystal structure was added. Furthermore, 0.3% by mass of a methylsilicone resin was added. Thus, the soft magnetic materials of Examples 1 to 4 were obtained.

In the compacting step (S21), a pressure of 1000 MPa was applied to the soft magnetic material to make a compact. In the second heat-treatment step (S22), the compact was heat-treated at 500° C. in a nitrogen stream atmosphere for one hour. Thus, the dust core of Example 1 to 4 was manufactured.

Comparative Examples 1 to 4

The soft magnetic materials of Comparative Examples 1 to 4 were basically manufactured in the same manner as the soft magnetic material of Example 2. However, the coefficient of variation Cv, the circularity Sf, and the average particle size (0 were changed to the values described in Table below. The dust core of Comparative Examples 1 to 4 were manufactured in the same manner as in Example 1.

(Evaluation Method)

For each of the dust cores of Examples 1 to 4 and Comparative Examples 1 to 4, the DC bias characteristics and eddy current loss were measured.

Figure 10:
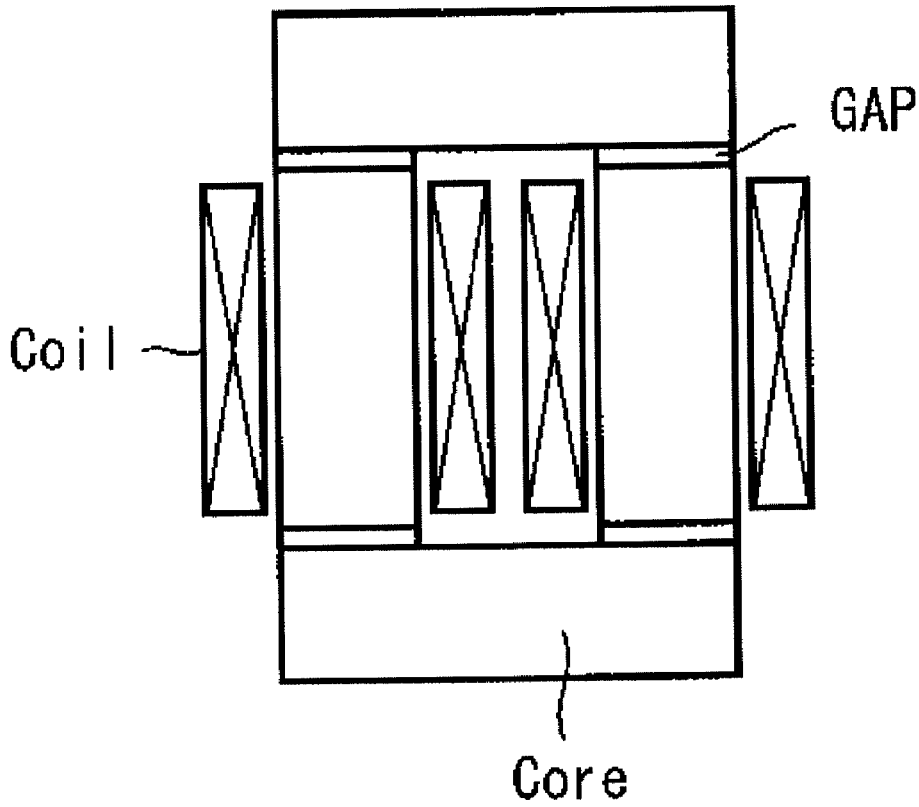
FIG. 10 is a schematic view showing a device for measuring DC bias characteristics in Examples.
Figure 11:
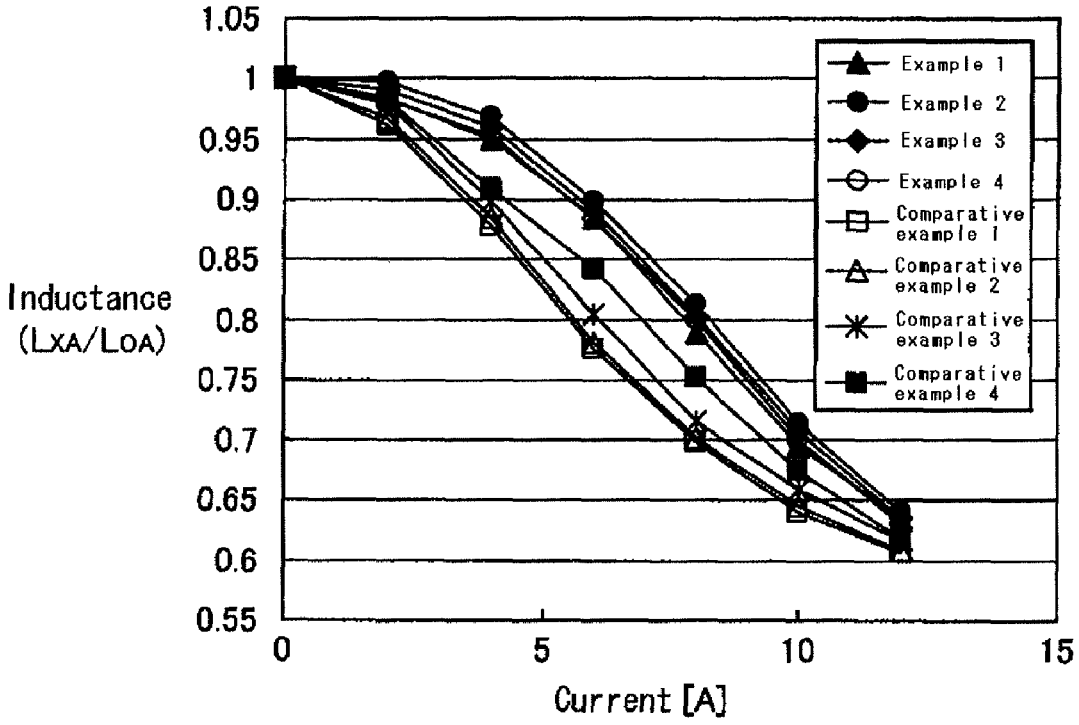
FIG. 11 is a graph showing DC bias characteristics in Examples.

Specifically, the DC bias characteristics were measured using a DC bias tester after test samples were set up as shown in FIG. 10. FIG. 11 and Table show the results. FIG. 10 is a schematic view showing a device for measuring DC bias characteristics in Examples. FIG. 11 is a graph showing DC bias characteristics in Examples. In FIG. 11, the axis of ordinates represents the ratio ($L_{xA}/L_{0A}$) (unit: none) of inductance $L_{xA}$ at x A to inductance $L_{0A}$ at 0 A and the axis of abscissas represents the current (unit: A) applied. $L_{8A}/L_{0A}$ in Table means the ratio of inductance $L_{8A}$ at 8 A to inductance $L_{0A}$ at 0 A.

After an iron loss was measured, an eddy current loss was evaluated by separating the iron loss into a hysteresis loss and an eddy current loss on the basis of the frequency dependency of the iron loss. Specifically, for each of the obtained dust cores of Examples 1 to 4 and Comparative Examples 1 to 4, a primary winding with 300 turns and a secondary winding with 20 turns were wound around a ring-shaped compact (after heat treatment) with an outer diameter of 34 mm, an inner diameter of 20 mm, and a thickness of 5 mm, to prepare magnetic characteristic measurement samples. The iron loss of these samples was measured at an excitation flux density of 1 kG (=0.1 T (tesla)) at various frequencies from 50 Hz to 10000 Hz using an alternating current (AC)-BH curve tracer. The eddy current loss was then calculated from the iron loss. Table shows the results. With the following three equations, the eddy current loss was calculated by fitting the frequency curve of the iron loss using a least-squares method.

$$(\text{Iron Loss})=(\text{Hysteresis Loss Coefficient})\times(\text{Frequency})+(\text{Eddy Current Loss Coefficient})\times(\text{Frequency})^2$$

$$(\text{Eddy Current Loss})=(\text{Eddy Current Loss Coefficient})\times(\text{Frequency})^2$$

TABLE 1

| | Metal magnetic particle | | | | | Eddy |
|---|---|---|---|---|---|---|
| | Coefficient of variation Cv | Circularity Sf | Average particle size (μm) | Lubricant | $L_{SA}/L_{OA}$ | current loss [kW/m$^3$] |
| Example 1 | 0.40 | 0.80 | 120 | Zn. St | 0.79 | 61 |
| Example 2 | 0.38 | 0.91 | 120 | Zn. St | 0.81 | 56 |
| Example 3 | 0.36 | 0.92 | 70 | Zn. St | 0.80 | 31 |
| Example 4 | 0.36 | 0.92 | 65 | EBS | 0.79 | 50 |
| Comparative example 1 | 0.48 | 0.76 | 121 | Zn. St | 0.70 | 76 |
| Comparative example 2 | 0.47 | 0.75 | 120 | Zn. St | 0.70 | 75 |
| Comparative example 3 | 0.47 | 0.83 | 123 | Zn. St | 0.72 | 61 |
| Comparative example 4 | 0.40 | 0.75 | 122 | Zn. St | 0.75 | 73 |

(Measurement Results)

As evident from FIG. 11 and Table, in Examples 1 to 4 in which the metal magnetic particles whose coefficient of variation Cv (σ/μ) is 0.4 or less and circularity Sf is 0.8 or more and 1.0 or less are included, inductance decreased less and DC bias characteristics were better than in Comparative Examples 1 to 3.

Comparing Example 1 with Comparative Example 4, in both of which the metal magnetic particles have substantially the same particle size and coefficient of variation, it was found that an eddy current loss could be suppressed as the circularity increased. Therefore, comparing Example 1 with Examples 2 to 4, in which the metal magnetic particles have a circularity of 0.91 or more, it was revealed that better bias characteristics and a lower eddy current loss could be achieved when the circularity was 0.91 or more.

Comparing Examples 3 and 4 with Example 1, in all of which the metal magnetic particles have substantially the same coefficient of variation Cv, better DC bias characteristics and a lower eddy current loss could be achieved when the average particle size was small. Moreover, comparing Example 3 with Example 4, a low hysteresis loss is achieved and the best characteristics are exhibited by improving the heat-resistance temperature of the insulating coated film using a metallic soap.

In Examples, as described above, it was confirmed that the DC bias characteristics of the soft magnetic materials including metal magnetic particles whose coefficient of variation Cv (σ/μ), which is the ratio of the standard deviation (σ) of the particle size to its average particle size (μ), is 0.40 or less and whose circularity Sf is 0.80 or more and 1 or less could be improved.

It should be considered that the embodiment and Examples disclosed herein are all exemplary and not restrictive. The scope of the present invention is determined by the appended claims but not the embodiment described above, and any modifications can be made within the spirit and scope of the appended claims or the equivalents.

INDUSTRIAL APPLICABILITY

The soft magnetic material, the dust core, the method for manufacturing the soft magnetic material, and the method for manufacturing the dust core according to the present invention can be applied to, for example, an iron core of a static apparatus such as a transformer, a choke coil, or an inverter.

The invention claimed is:

1. A soft magnetic material comprising:

a plurality of metal magnetic particles, wherein the metal magnetic particles are iron or iron alloy, wherein a coefficient of variation Cv (σ/μ), which is a ratio of a standard deviation (σ) of a particle size of the metal magnetic particles to an average particle size (μ) thereof, is 0.40 or less and a circularity Sf of the metal magnetic particles is 0.80 or more and 1 or less; and an additive composed of at least one of a metallic soap and an inorganic lubricant with a hexagonal crystal structure, wherein a ratio of the additive to the plurality of metal magnetic particles is 0.001% by mass or more and 0.2% by mass or less.

2. The soft magnetic material according to claim 1, wherein the metal magnetic particles have an average particle size of 1 μm or more and 70 μm or less.

3. The soft magnetic material according to claim 1, further comprising an insulating coated film that surrounds a surface of each of the metal magnetic particles, wherein the insulating coated film is composed of at least one material selected from the group consisting of a phosphoric acid compound, a silicon compound, a zirconium compound, and a boron compound.

4. The soft magnetic material according to claim 3, wherein the insulating coated film is one insulating coated film;

wherein the metal magnetic particles each includes another insulating coated film that surrounds a surface of the one insulating coated film; and wherein the other insulating coated film contains a thermosetting silicone resin.

5. A dust core manufactured using the soft magnetic material according to claim 1.

6. A method for manufacturing a soft magnetic material, comprising:

a preparation step of preparing a plurality of metal magnetic particles, wherein the metal magnetic particles are iron or iron alloy, wherein, in the preparation step, the metal magnetic particles whose coefficient of variation Cv ($\sigma/\mu$), which is a ratio of a standard deviation ($\sigma$) of a particle size to an average particle size ($\mu$), is 0.40 or less and whose circularity Sf is 0.80 or more and 1 or less are prepared by an atomizing method; and an addition step of adding an additive composed of at least one of a metallic soap and an inorganic lubricant with a hexagonal crystal structure, a ratio of the additive to the plurality of metal magnetic particles being 0.001% by mass or more and 0.2% by mass or less.

7. The method for manufacturing the soft magnetic material according to claim 6, wherein, in the preparation step, the metal magnetic particles having an average particle size of 1 μm or more and 70 μm or less are prepared.

8. The method for manufacturing the soft magnetic material according to claim 6, further comprising an insulating coated film formation step of forming an insulating coated film on a surface of each of the metal magnetic particles, wherein, in the insulating coated film formation step, the insulating coated film composed of at least one material selected from the group consisting of a phosphoric acid compound, a silicon compound, a zirconium compound, and a boron compound is formed.

9. The method for manufacturing the soft magnetic material according to claim 8, wherein the insulating coated film formation step includes:

one insulating coated film formation step of forming the insulating coated film as one insulating coated film; and another insulating coated film formation step of forming another insulating coated film that surrounds a surface of the one insulating coated film; and wherein, in the other insulating coated film formation step, the other insulating coated film containing a thermosetting silicone resin is formed.

10. A method for manufacturing a dust core, comprising the steps of:

manufacturing a soft magnetic material using the method for manufacturing the soft magnetic material according to claim 6; and manufacturing the dust core by compacting the soft magnetic material.

11. The method for manufacturing the soft magnetic material according to claim 6, wherein, in the preparation step, the metal magnetic particles are prepared by a water-atomizing method.

* * * * *